US005277445A

United States Patent [19]

Yamagata

[11] Patent Number: 5,277,445

[45] Date of Patent: Jan. 11, 1994

[54] FILING BOOK WITH BAG SHEET

[75] Inventor: Ichiki Yamagata, Nara, Japan

[73] Assignee: Yamagata Guraviya Co., Ltd., Osaka, Japan

[21] Appl. No.: 865,017

[22] Filed: Apr. 8, 1992

[30] Foreign Application Priority Data

Dec. 25, 1991 [JP] Japan ..... 3-112251[U]

[51] Int. Cl.[5] ..... B42D 1/06

[52] U.S. Cl. ..... 281/15.1; 281/21.1; 281/29; 412/3; 412/1

[58] Field of Search ..... 281/15.1, 21.1, 29, 281/51; 412/3, 1

[56] References Cited

U.S. PATENT DOCUMENTS 4,844,508 7/1989 Choi ..... 251/51 X 5,002,447 3/1991 Borel ..... 281/21.1 X

*Primary Examiner*—Paul A. Bell

*Attorney, Agent, or Firm*—Millen, White, Zelano & Branigan

[57] ABSTRACT

A filing book with bag sheets comprising a cover sheet and a plural number of bag sheets made of plastics and fixed tightly at the central part of the inside of the cover sheet by heat sealing to form a singly bound book has a structure that the central parts of all of a number of bag sheets are tightly fixed with the cover sheet of paper by heat sealing through an intermediate laminate of paper and plastics film, an intermediate plastic bonding tape or a plastic sheet laminated to the cover sheet.

The filing book with bag sheets stands upright firmly, gives comfortable feeling to hands by providing stiffness and smoothness to the cover sheet because the cover sheet is made mainly with paper and, at the same time, can be prepared easily by fixing the bag sheets tightly with the cover sheet by heat sealing even though the cover sheet is mainly made of paper.

7 Claims, 4 Drawing Sheets

FILING BOOK WITH BAG SHEET

BACKGROUND OF THE INVENTION

1. Field of the Invention

The present invention relates to filing books with bag sheets. More particularly, the present invention relates to filing books with bag sheets which have a cover sheet with excellent stiffness and smoothness and can be prepared easily.

2. Description of the Prior Art

Filing books with bag sheets in which a number of plastic bag sheets are bound together to a form of book are widely used as filing books to keep documents, samples and the like.

There are three kinds of structures in the filing book with bag sheets. One has openings at the upper side of the book (upper opening). A second one has openings at the sides facing a folding part at a central part of the book (inside opening) and a third one has openings at both of opposite sides to the folding part of the book (outside opening). The structure of the inside opening is most widely used because this structure has less danger of losing the contents from the book.

Filing books with bag sheets entirely made of plastics are widely used. When these books are composed of bag sheets made of a thermoplastic film and a cover sheet also made of a thermoplastic film, the bag sheets can be fixed together with the cover sheet by heat sealing at the central part to the form of a book and fabrication of filing books can be performed easily.

Thus, it is necessary for the efficient fabrication of filing books in conventional practices that both of the cover sheet and the bag sheets are made of thermoplastic materials.

However, when cover sheets at the both sides of the front cover and the back cover of the book are made of plastic materials, filing books do not stand by themselves because of insufficient stiffness. This makes it difficult to store these filing books by standing them upright on desks, shelves and the like. Moreover, when a number of filing books are arranged in a row for storage, covering sheets of adjacent books do not move smoothly because they stick to each other. This creates another problem for storing filing books, particularly when the books are stored by standing in a row on desks, shelves and the like. The cover sheets of plastic creates still another problem in that the feeling to hands during the handling is rather uncomfortable and people do not like it.

SUMMARY OF THE INVENTION

The present invention accordingly has an object providing a filing book with bag sheets which stands upright firmly while having good tactile properties resulting from stiffness and smoothness of the cover sheet due to making the cover sheet mainly with paper by fixing the bag sheets tightly to the cover sheet with heat sealing even though the cover sheet is mainly made of paper.

The object described above is based on utilization of an intermediate plastic sheet between the cover sheet and the bag sheets for the purpose of fixing the cover sheet made of paper and the bag sheets made of plastics together.

One aspect of the present invention is directed to a filing book with bag sheets wherein the filling book comprises a cover sheet and a plural number of bag sheets made of plastics and fixed tightly at the central part of the inside of the cover sheet by heat sealing to form a singly bound book in which the cover sheet is made of a laminate of a paper sheet and a plastic film. The side of the plastic film of the laminate of the cover sheet is placed to the inside and the central parts of all of the plural number of bag sheets are fixed with respect to each other and to the central part of the plastic film of the laminate of the cover sheet by heat sealing.

Another aspect is directed to a filing book with bag sheets wherein the filling book comprises a cover sheet and a plural number of bag sheets made of plastic and fixed tightly at the central part of the inside of the cover sheet by heat sealing to form a singly bound book in which the cover sheet is made of a paper sheet wherein an intermediate laminate sheet of a paper and plastic film is fixed to the central part of the cover sheet by adhesion of the side of the paper sheet of the with the cover sheet and the central parts of all of the bag sheets are fixed with respect to each other and to the side of the plastic film of the intermediate laminate sheet by heat sealing.

Still another aspect is directed to a file with bag sheets, which file comprises a cover sheet made of paper sheet, an intermediate plastic film fixed to the central folding part of the inside of the cover sheet by adhesion and a plural number of bag sheets made of plastic film fixed to the intermediate plastic film by heat sealing.

Other and further objects, features and advantages of the invention will appear more fully from the following description.

BRIEF DESCRIPTION OF THE DRAWINGS

The invention will be described with reference to the accompanying drawings, wherein.

DETAILED DESCRIPTION

Numbers and notations shown in the figures refer to the following structure: 1: a cover sheet made of paper; 2: a folding line; 3: a laminate sheet for heat sealing; 4: a bag sheet; 5: a plastic film; 6: a paper sheet; 7: a layer of an adhesive; 8: a heat sealed part at the central part of a bag sheet; 11: a cover sheet; 12: a fixing tape; 13: a folding line; 14: a bag sheet; 15: an opening; 50: a film part of a bag sheet; 42: a sheet of a core material; 44: a bonding space at the center; and 56 and 58: a parts where the upper edge and the lower edge are fixed by heat sealing.

Figure 1:
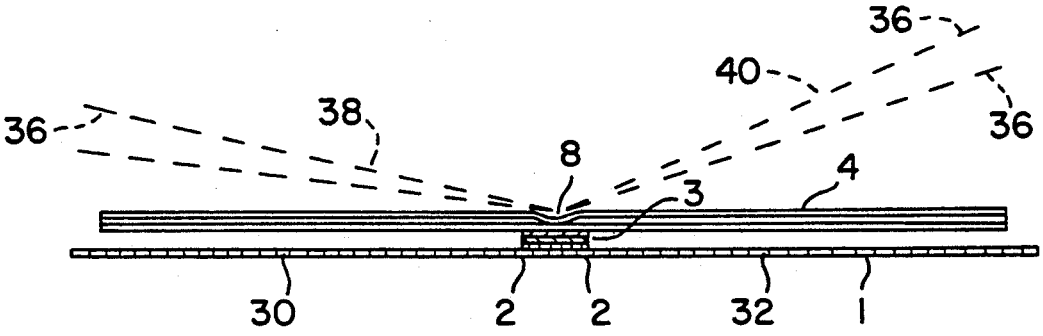
FIG. 1 is a section view of an example of the filing book with bag sheets of the invention.

FIG. 1 is a section view of an example of the filing book with bag sheets of the invention. In the figure, only one of the bag sheet 4 is shown fixed to the cover sheet 1 by heat sealing. Actually, a number of bag sheets are placed on the first sheet or cover sheet 1 shown in the figure and fixed with each other by heat sealing to form a book comprising a number of bag sheets 4.

The bag sheet 4 utilized in the invention is formed with a plastic film.

Material of the plastic film utilized for the bag sheet is not particularly limited so long as it is a thermoplastic material. Polypropylene film is preferable because of the strength and the transparency.

As the structure of the bag sheet in the invention, the structure having the openings at the side faced to the folding part at the central part of the book (inside opening) is preferred but other structures such as one having the openings at the upper side of the book (upper opening) can be utilized according to desire.

Figure 4:
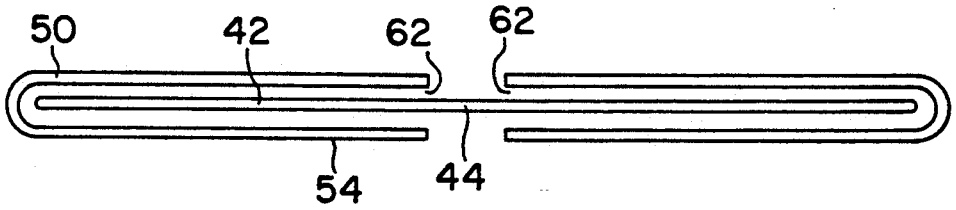
FIG. 4 is a section view showing the laminate structure of an example of the bag sheet utilized for the filing book with bag sheets of the invention.

The structure of the bag sheet shown in the section view of FIG. 4 having two separate bag sheets at the both sides and a core sheet inserted between the two bag sheets can be favorably utilized.

The bag sheet shown in FIG. 4 has the structure of the inside opening. The core sheet and the bag sheets are fixed to each other by heat sealing at both of the upper edge sealing line and the lower edge sealing line. In this structure, the core sheet connects the two bag sheets at the both sides.

When the combined sheet composed of the core sheet and the bag sheets is bound together by heat sealing at the central part to form a book, the bag container portions having openings to the side of the bound part at the inside of the book are formed at the both sides of the core sheet. Thus, four bag containers are formed to each one of the combined sheet.

Each of the bag sheet parts of the combined sheet can be divided into two parts or three parts by heat sealing the bag sheet linearly along a line or two lines parallel to the upper and lower edges. In this way, eight bag containers or twelve bag containers are formed to each of the combined sheet.

The bag sheet is fixed to the cover sheet at the central part.

According to the invention, the central part of the first sheet of the bag sheets is fixed to the plastic film laminated to the back side of the cover sheet of paper by heat sealing.

The plastic film utilized for fixing the bag sheet is tightly fixed to the cover sheet of paper by the method of dry laminating, by utilizing an adhesive or by other like methods.

When the filing book has the structure having the openings at both of the opposite sides to the folding part of the book (outside opening), it can be conveniently made by utilizing a plastic film made by merely cutting a cylindrical film of a simple structure to a desired length. However, the structure of the outside opening has a problem that things contained in the bag sheet easily slip out from the bag sheet and it is desirable that the filing book has a structure having a stopper to close the both cover sheets at the open ends. When the structure has a core sheet between the two bag sheets, at least four bag containers are formed to each of the combined sheet.

The invention has three features in relation to the method utilized for the heat sealing. The first feature is related to the method of laminating a plastic film to the whole part of the back side of the cover sheet of paper and, then, fixing the bag sheet to the laminated plastic sheet by heat sealing.

The second feature is related to the method of fixing a piece of a separate laminate sheet of paper and plastic film to the central part of the cover sheet of paper by placing the side of paper of the laminate sheet faced to the cover sheet of paper and by fixing the both paper faces with an adhesive and, then, fixing the bag sheet to the side of plastic film of the laminate sheet by heat sealing.

The third feature is related to the methods of fixing a piece of a plastic film in place of the piece of the laminate sheet in the method of the second feature to the central part of the cover sheet of paper by an adhesive and, then, fixing the bag sheet to the plastic film by heat sealing.

As the method of the heat sealing in the invention, ultrasonic sealing, sealing by heating or microwave sealing can be utilized. The ultrasonic sealing is preferable among them.

In the process of the heat sealing in the invention, both of heat sealing of the cover sheet and the first sheet of the bag sheets and heat sealing of the remaining plural number of bag sheets with each other and with the combined sheet of the cover sheet and the first sheet can be performed in a single process like in the conventional process for making filing books.

DESCRIPTION OF THE PREFERRED EMBODIMENTS

The invention will be understood more readily with reference to the following examples and drawings; however, these examples and drawings are intended to illustrate the invention and are not to be construed to limit the scope of the invention.

FIG. 1 shows an example related to the second feature of the invention. The bag sheet 4 forming a pair of leaves of a filling book and the cover sheet 1 are fixed with respect to each other through the laminate sheet of paper and a plastic sheet 3.

The first sheet 4 is tightly fixed to the cover sheet of paper through the intermediate laminate sheet by heat sealing. In the structure shown in FIG. 1, the first bag sheet 4 alone is fixed to the cover sheet 1 for the simplicity of description, but a second sheet and following sheets can be fixed above the first sheet 4 by heat sealing even though they are not shown in the figure.

Figure 2:
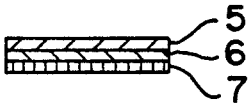
FIG. 2 is a drawing showing the sectional structure of a laminate sheet for heat sealing utilized for an example of the filing sheet with bag sheets of the invention.

The laminate sheet 3 forms a binding strip has the structure of a paper sheet 5 laminated with a plastic sheet 5, as shown in the section view of FIG. 2, and fixed through the layer of adhesive 7 applied to the surface of the paper at the central part of the cover sheet of paper as a long strip.

The cover sheet 1 has two folding lines 2 parallel to the margin space for binding at the both sides and is folded at the folding lines toward the inside. The cover sheet 1 can have the folding lines 2 and can be folded by utilizing the folding lines 2 because it is made of paper. The folding lines can be made by utilizing conventional methods of making folding lines, such as pressing with a mold and define a binding area 20 therebetween.

The filing book with bag sheets 4 of the invention can be made into a square stiff shape on standing by the effect of the folding lines in the cover sheet 1. The stiff shape and the increased stiffness of the cover sheet 1 itself make a number of the filing books firmly standing between book ends with good stability and appearance of the filing books is kept in good shape in a book shelf. Letters and marks can freely be written on the part of paper in the filing book, such as the outer side of the cover sheet 1 and the remaining parts of the inner side of the cover sheet.

Figure 3:
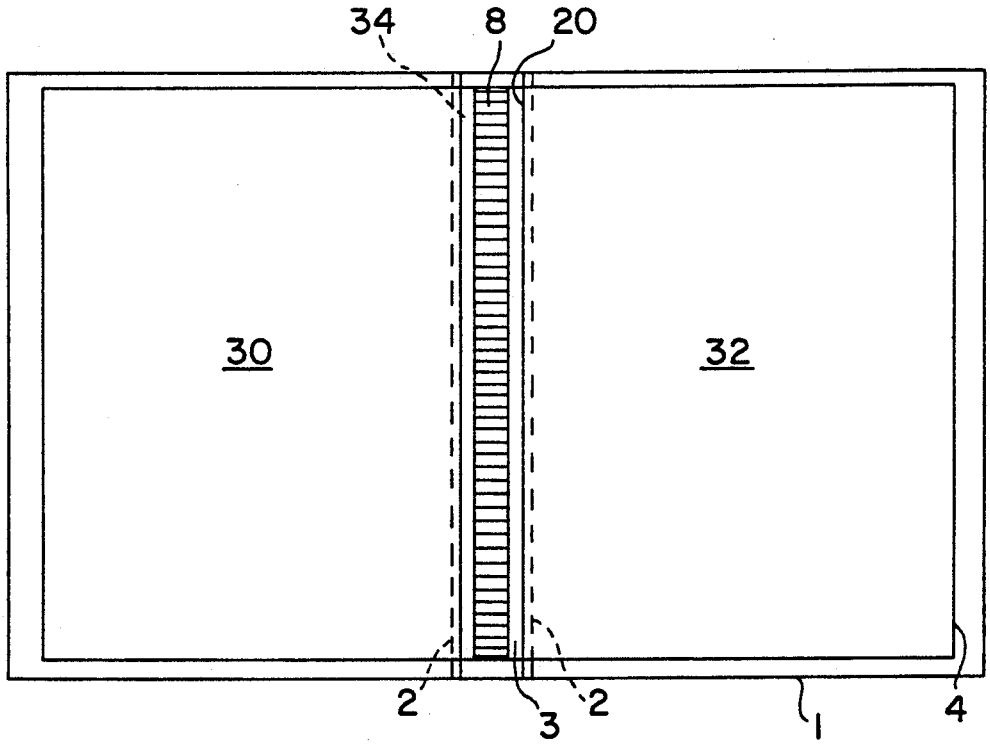
FIG. 3 is a plan view of an example of the filing book with bag sheets of the invention.

All of the bag sheets 4 are fixed with the cover sheet 1 and with each other simultaneously by heat sealing at the area of a long strip by ultrasonic heat sealing or the like as shown in FIG. 3.

In the filing book with bag sheets 4 of the invention, a plastic sheet is laminated on the inner side of the cover sheet. This description does not exclude the structure having a plastic sheet laminated on the outer side of the cover sheet for the purpose of providing resistance to water and for other purposes. This kind of structure maintains the major advantage of the invention that the filing book stands firmly and keeps good shape even though letters and marks are not freely written on the cover sheets 1 or the cover sheets give less comfortable feeling to hands.

Figure 6:
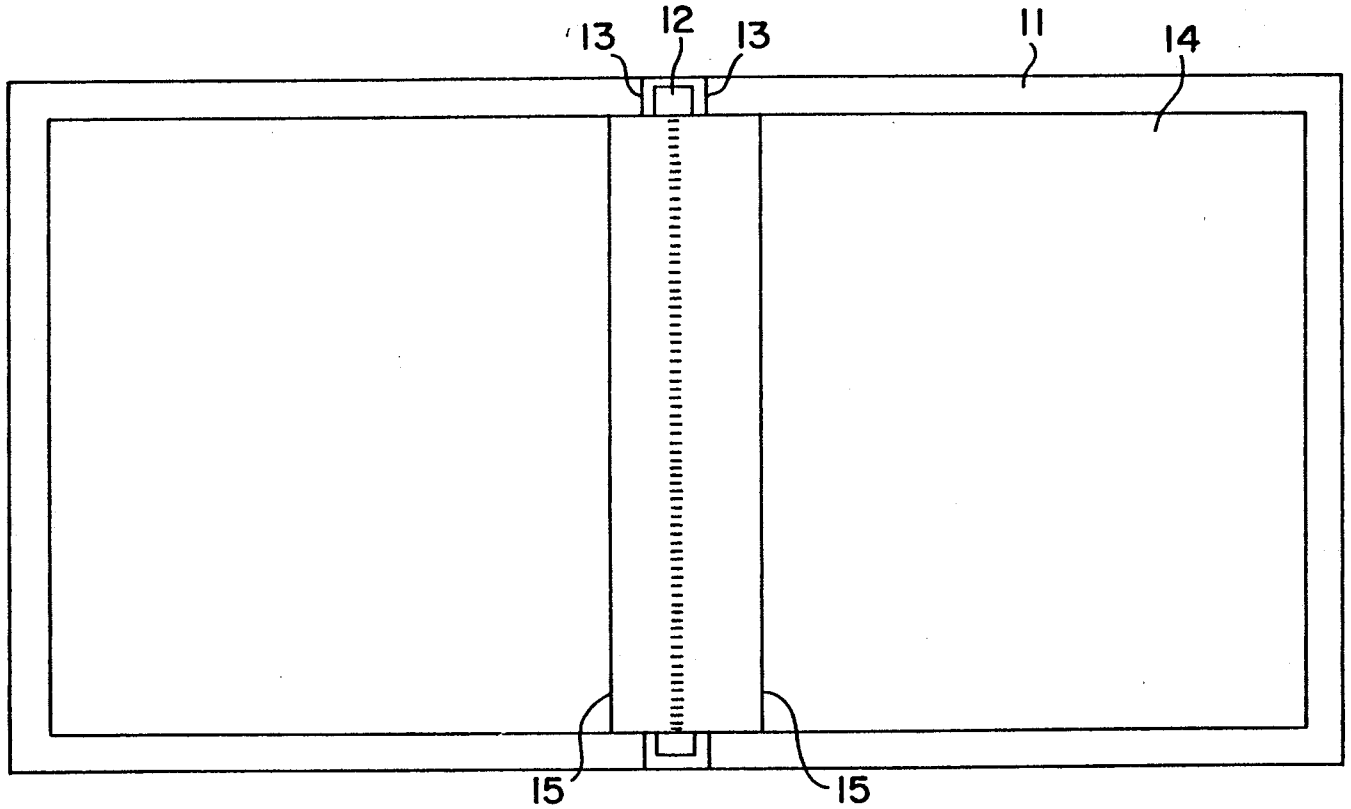
FIG. 6 is a plan view of an example of the invention.

The third feature of the invention is exemplified in a plan view of FIG. 6. The structure is the same as the structure in the second feature except that a plastic sheet is utilized in place of the laminate sheet for heat sealing.

Figure 7:
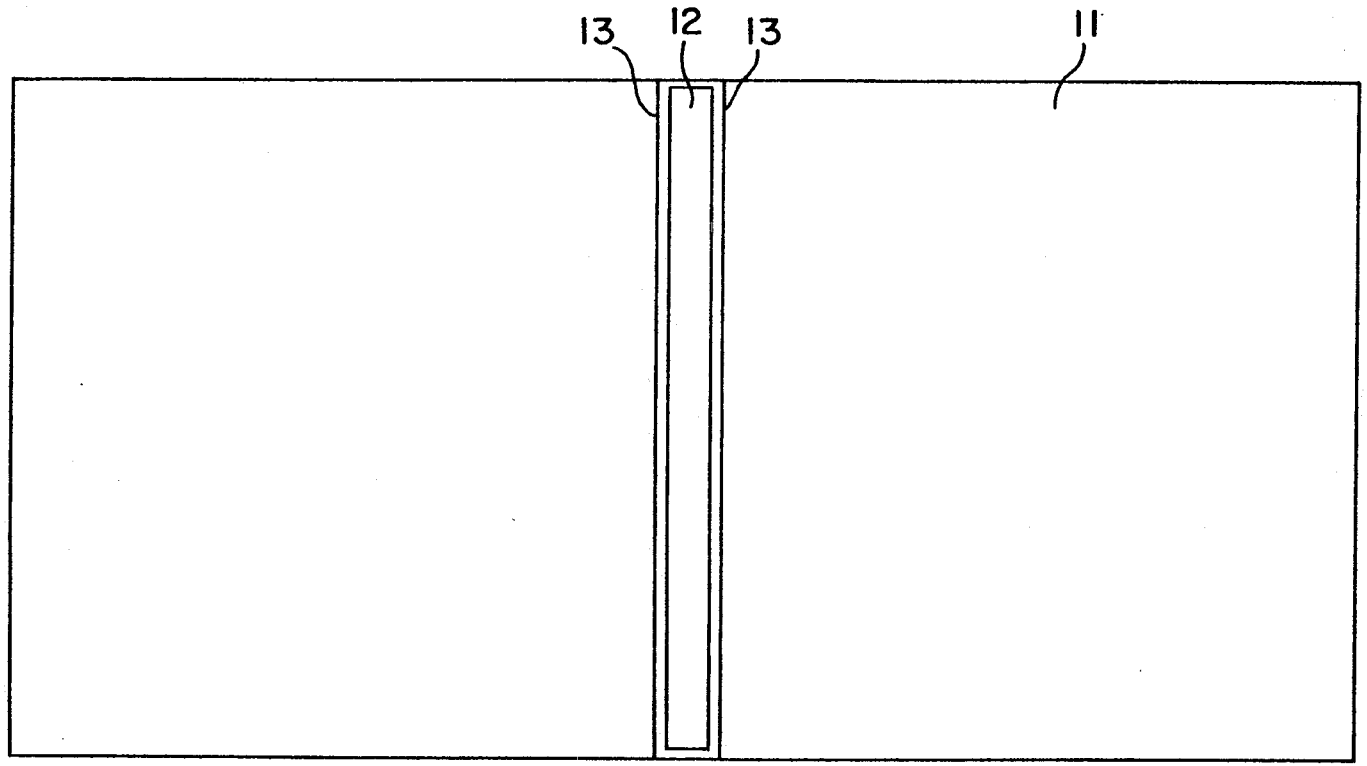
FIG. 7 is a plan view of a part of the cover sheet of an example of the invention.

The structure of the third feature comprises a bundle of the bag sheets of plastic film 14 and a cover sheet of paper 11 fixed with an intermediate bonding tape 12 for heat sealing. FIG. 7 is a plan view of the inner side of the cover sheet 11 in which the bundle of the bag sheets 14 are removed from the cover sheet. The intermediate bonding tape 12 of plastic film is fixed to the part along the central line of the inner side of the cover sheet 11 with an adhesive. Any kind of adhesive can be utilized so long as it fixes the plastic film 14 to the cover sheet tightly. Examples of such adhesive are conventional pressure sensitive adhesives, conventional crosslinking adhesives and the like. Folding lines 13 are made on the cover sheet at the both side of the intermediate bonding tape 12.

The filing book with bag sheets of the invention can be prepared by placing a number of bag sheets 14 having the opening 15 at the inside on the inner side of the cover sheet shown in FIG. 7 and heat sealing all of the sheets at the central part by a method like ultrasonic heat sealing to form a tightly heat sealed structure between the bag sheets 14 and, at the same time, to form a tightly heat sealed structure between the first bag sheet 14 and the intermediate bonding tape 12 fixed to the surface of the cover sheet 11.

As the method of heat sealing all of the bag sheets 14 and the intermediate binding tape 12 tightly with each other, any kind of methods may be utilized. Among them, ultrasonic heat sealing is preferable because a number of plastic films 14 are fixed simultaneously and also because heating only from inside of the cover sheet 11 can be performed.

The first feature of the invention is the same as the third feature of the invention except that a plastic film is laminated to the all area of the inner side of the cover sheet of paper 11 in place of the intermediate bonding tape 12. The heat sealing can be made in the same way as in the third feature.

While the invention has been particularly shown and described with reference to preferred embodiments thereof, it will be understood by those skilled in the art that the foregoing and other changes in form and details can be made therein without departing from the spirit and scope of the invention.

To summarize the advantages obtained by the invention, the afore-described filing book with bag sheets has stiffness, stands upright firmly and may be conveniently utilized on a desk or a shelf because the outer sides of the cover are made of stiff paper though the inner portions are made of soft plastics. The property of standing firmly is further enhanced by having a square stiff shape wherein two folding lines are made on the both sides of the binding space. This results in an improved appearance as well as better file keeping. Another advantage is better hand.

Fabrication is easily performed because bag sheets made of plastics can be heat sealed even though the cover sheets are mainly made of paper.

Figure 5:
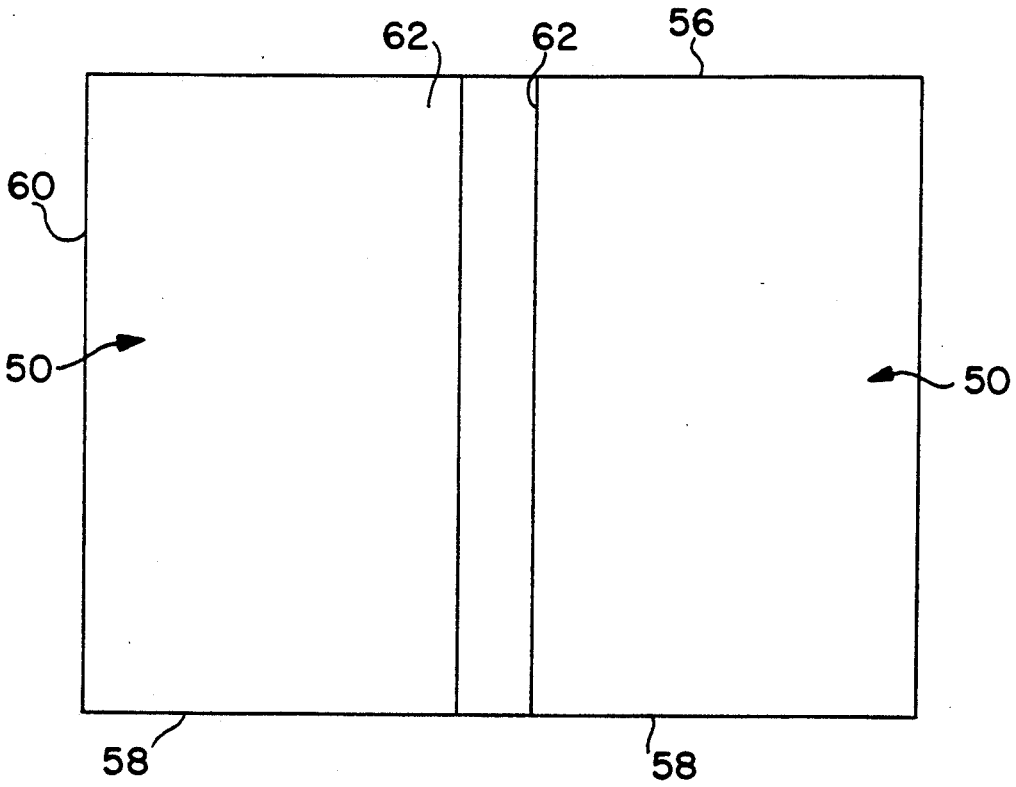
FIG. 5 is a plan view of the bag sheet shown in FIG. 4.

In a still more definitive aspect, the filing book comprises a cover sheet 1 made of a relatively stiff paper material, the cover sheet having first and second panels 30 and 32 and a binding area 34 disposed between the first and second panels. As is seen in FIG. 1, there are a plurality of first and second book leaf pairs illustrated schematically by dotted lines 36. Each book leaf pair 36 includes a right hand leaf 38 and a left hand leaf 40. As is shown in FIG. 1 and in FIGS. 4 and 5, each book leaf pair has a plastic core 42 having a width equal to two leaves 38 and 40 and having a leaf binding area 44 between the two leaves.

Each book leaf pair further includes a plastic bag in the form of a plastic envelope 50 of transparent plastic material disposed over each leaf (38 and 40) for the plastic core sheet 42. Each envelope 50 has front and rear areas 52 and 54, respectively, joined to one another at top, bottom and side edges 56, 58 and 60, respectively, with a mouth 62 disposed proximate the leaf binding area 44 for receiving inserts therethrough between the front and rear areas 52 and 54 of the plastic envelope and the core sheet 42. Each of the plastic envelopes is bonded to its respective plastic core sheet at the top and bottom edges 56 and 58 thereof. As is seen in FIG. 1, the book leaf pairs 36 are superimposed over one another and bonded to the cover sheet by adhering the binding areas 44 of the core sheets to one another and the binding area 44 of the bottom core sheet to the binding area 34 of the cover sheet.

The envelopes may be subdivided into pouches 70 by bonding lines 72 which heat bond the envelope 50 to the plastic core sheet 42.

What is claimed is:

1. A filing book comprising:

a cover sheet made of relatively stiff paper material, the cover sheet having first and second panels and a binding area disposed between the first and second panels;

a plurality of book leaf pairs, each book leaf pair including a single plastic core sheet having a width of two leaves with a leaf binding area disposed therebetween and separating the leaf pair into two leaves;

each book leaf pair further including a plastic envelope of transparent plastic material disposed over each leaf of the plastic core sheet, each envelope having front and rear areas joined at the top, bottom and side edges with a mouth disposed proximate the leaf binding area for receiving inserts therethrough between the front and rear areas and the plastic core sheet, each plastic envelope being bonded to one of the plastic core sheets at the top and bottom edges; and means for mounting the book leaf pairs superimposed over one another to the cover sheet by adhering the binding areas of the core sheets to one another and the binding area of a bottom core sheet to the binding area of the cover sheet, whereby when the first and second panels of the cover sheet are folded to overlie one another, the book leaf pairs are folded to overlie one another and are sandwiched between the first and second panels of the cover.

2. The filing book of claim 1, wherein the cover sheet is made of paper material and the means for mounting the book leaf pairs is a strip having a first surface which adheres to the bottom core sheet and a second surface which adheres to the cover sheet.

3. The filing book of claim 2, wherein the page of the leaves are divided into a plurality of pouches by heat bonding plastic envelopes to the plastic core sheets along lines extending parallel to the top and bottom edges of the plastic envelopes.

4. The filing book of claim 1, wherein plastic film is fixed over the binding area of the paper cover sheet and the plastic core sheet is bonded to the plastic film by heat bonding.

5. The filing book of claim 4, wherein the page of the leaves are divided into a plurality of pouches by heat bonding plastic envelopes to the plastic core sheets along lines extending parallel to the top and bottom edges of the plastic envelopes.

6. The filing book of claim 1, wherein the page of the leaves are divided into a plurality of pouches by heat bonding plastic envelopes to the plastic core sheets along lines extending parallel to the top and bottom edges of the plastic envelopes.

7. The filing book of claim 1, wherein the cover sheet includes a pair of parallel folding lines separating the binding area from the first and second panels, the lines facilitating folding of the first and second panels of the cover sheet over the leaves.

* * * * *